US010797411B2

(12) United States Patent
Eiberger et al.

(10) Patent No.: US 10,797,411 B2
(45) Date of Patent: Oct. 6, 2020

(54) CONDUCTING ARRANGEMENT AND METHOD FOR PRODUCING A CONDUCTING ARRANGEMENT

(71) Applicant: TE Connectivity Germany GmbH, Bensheim (DE)

(72) Inventors: Richard Eiberger, Unterschneidheim (DE); Rudi Blumenschein, Ellwangen (DE); Uwe Hauck, Kleinmanchow (DE); Andre Martin Dressel, Lampertheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/393,118

(22) Filed: Apr. 24, 2019

(65) Prior Publication Data

US 2019/0326689 A1 Oct. 24, 2019

(30) Foreign Application Priority Data

Apr. 24, 2018 (DE) ..... 10 2018 109 837

(51) Int. Cl.
*H01R 4/62* (2006.01)
*H01R 43/02* (2006.01)

(52) U.S. Cl.
CPC ..... *H01R 4/625* (2013.01); *H01R 43/0207* (2013.01); *H01R 43/0221* (2013.01)

(58) Field of Classification Search
CPC ..... H01R 43/0207; H01R 43/0221; H01R 4/625; H01R 4/62; H01R 4/4302
USPC ..... 174/74 R, 84 R, 88 R, 88 B
See application file for complete search history.

(56) References Cited

U.S. PATENT DOCUMENTS

2004/0134062 A1* 7/2004 Jonli ..... H01R 4/021 29/872
2009/0229880 A1* 9/2009 Watanabe ..... H01R 4/183 174/72 A
2013/0312992 A1* 11/2013 Guetig ..... H05K 3/3421 174/34
2016/0072199 A1* 3/2016 Miyamoto ..... H01R 4/023 228/110.1
2016/0129861 A1* 5/2016 Oga ..... B60R 16/0215 174/72 A (Continued)

FOREIGN PATENT DOCUMENTS

DE 10 2016 110 628 A1 12/2017
EP 1 014 497 A2 * 12/1999 ..... H01R 4/62
WO WO 2007/042235 A1 * 4/2007 ..... H01R 43/02

OTHER PUBLICATIONS

German Office Action, Application No. 10 2018 109 837.5, dated Jan. 7, 2019, 6 pages (Continued)

*Primary Examiner* — William H. Mayo, III
(74) *Attorney, Agent, or Firm* — Barley Snyder

(57) ABSTRACT

A conducting arrangement comprises a first electrical conductor element having a first contact section with a first material and a second electrical conductor element having a second contact section welded to the first contact section. A side of the second contact section facing the first contact section has a predefined microstructure with a recess. The first material of the first contact section at least partially fills the recess of the predefined microstructure.

23 Claims, 4 Drawing Sheets

(56) References Cited

U.S. PATENT DOCUMENTS

| | | | | |
|---|---|---|---|---|
| 2018/0102202 | A1* | 4/2018 | Kuroishi | B60R 16/0215 |
| 2018/0134237 | A1* | 5/2018 | Araki | H02G 15/1806 |
| 2019/0067839 | A1* | 2/2019 | Ozaki | H01B 7/0009 |

OTHER PUBLICATIONS

Machine-generated translation of DE 10 2016 110 628, dated Jan. 7, 2019, 1 page.

* cited by examiner

CONDUCTING ARRANGEMENT AND METHOD FOR PRODUCING A CONDUCTING ARRANGEMENT

CROSS-REFERENCE TO RELATED APPLICATION

This application claims the benefit of the filing date under 35 U.S.C. § 119(a)-(d) of German Patent Application No. 102018109837.5, filed on Apr. 24, 2018.

FIELD OF THE INVENTION

The present invention relates to a conducting arrangement and, more particularly, to a conducting arrangement in which a first electrical conducting component is connected to a second electrical conducting component.

BACKGROUND

A conducting arrangement commonly has a first electrical conducting component and a second electrical conducting component connected to the first electrical conducting component. The first electrical conducting component may be welded to the second electrical conducting component. A weld, however, does not always reliably ensure contact safety between the first electrical conducting component and the second electrical conducting component.

SUMMARY

A conducting arrangement comprises a first electrical conductor element having a first contact section with a first material and a second electrical conductor element having a second contact section welded to the first contact section. A side of the second contact section facing the first contact section has a predefined microstructure with a recess. The first material of the first contact section at least partially fills the recess of the predefined microstructure.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
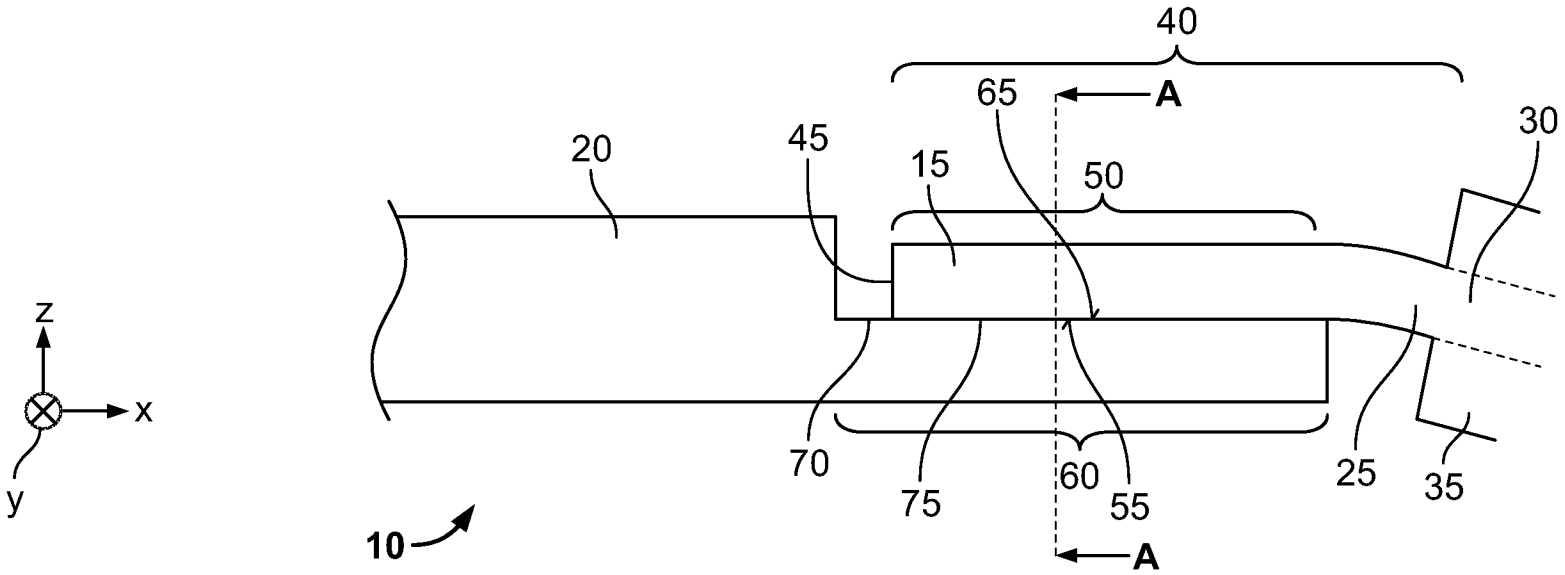
FIG. 1 is a side view of a conducting arrangement according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

A coordinate system shown in FIGS. 1-4 and 6 is configured as a right-handed system and has an x-axis (longitudinal direction), a y-axis (transverse direction), and a z-axis (vertical direction).

A conducting arrangement 10 according to an embodiment, as shown in FIG. 1, comprises a first electrical conductor element 15 and a second electrical conductor element 20.

In the embodiment shown in FIG. 1, the first electrical conductor element 15 is, by way of example, an electrical cable 25 with an electrical conductor 30 and a jacket 35. In other embodiments, the first electrical conductor element 15 can have other forms.

In an embodiment, the electrical conductor 30 may be formed for data transmission and, in the shown embodiment, comprises one or more wires. In various embodiments, the electrical conductor 30 can be formed with fine wires or very fine wires, or alternatively can also be formed as a solid wire. The jacket 35 insulates the electrical conductor 30 from an environment of the conducting arrangement 10 and/or from a further electrical conductor (not shown). The electrical conductor 30 has a first material. In an embodiment, the first material is copper, such as a pure copper electrode ("E-Cu") or Electrolytic-Tough-Pitch copper ("Cu-ETP"). In other embodiments, the electrical conductor 30 may be formed of other first materials.

In the embodiment shown in FIG. 1, the electrical cable 25 is formed as a flat-ribbon cable. In an embodiment, a further electrical cable 25, arranged in a plane with the electrical cable 25—in FIG. 1 on a side facing away from the viewer—can be provided, the two electrical cables 25 being combined to make the flat-ribbon cable and being connected to one another by the jacket 35. The electrical cable 25 can be suitable for the transmission of current, for example for the transmission of current for a drive of an electric machine, in particular for the transmission of high current.

As shown in FIG. 1, the electrical cable 25 has an end region 40. No jacket 35 is provided on the circumference at the end region 40. The end region 40 includes a first contact section 50; the first contact section 50 has a first contact face 55 at the circumference.

In the embodiment shown in FIG. 1, the second electrical conductor element 20 is a contact, in particular as a cell tap. In other embodiments, the second electrical conductor element 20 may have other forms, and may be a cell-balancing conductor.

The second electrical conductor element 20 has a second material. In the embodiment, the first material is different from the second material, and the first material may have a lower pulling strength than the second material. In an embodiment, the second material has aluminum, such as an aluminum alloy. In an embodiment, the aluminum alloy is suitable for welding, in particular for laser welding, and may be EN AW-1050A aluminum alloy or Al 1100 aluminum alloy.

The second electrical conductor element 20 has a second contact section 60, as shown in FIG. 1. The second contact section 60 has a second contact face 65. In the embodiment shown in FIG. 2, the first contact face 55 and the second contact face 65 are arranged, by way of example, substantially extending in a plane and opposite one another. At the first contact face 55, the first contact section 50 is adhered to the second contact face 65 by a welded connection 70. The welded connection 70 can be established, by way of example, by an ultrasound welding method, such as an ultrasound friction welding method.

In the embodiment shown in FIG. 1, the second electrical conductor element 20 has a predefined microstructure 75 on the second contact face 65. By way of the predefined microstructure 75, an effective area for adhesive bonding by the welded connection 70 between the first contact section 50 and the second contact section 60 is enlarged in a targeted manner at the microscopic level, and has a precisely defined surface form. As a result, the welded connection 70 can transfer particularly large forces between the first contact section 50 and the second contact section 60.

Figure 2:
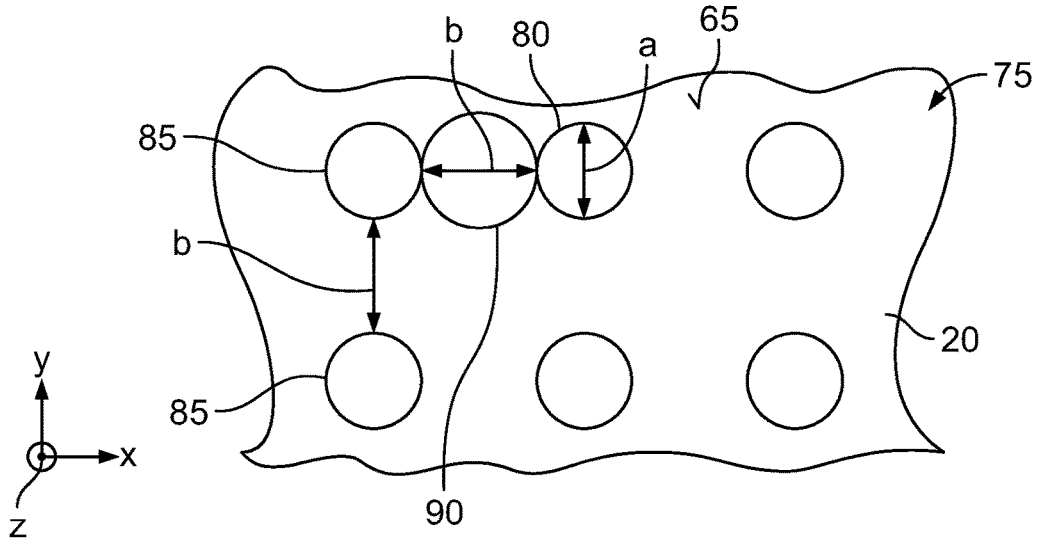
FIG. 2 is a plan view of a contact face of an electrical conductor element of the conducting arrangement.

The second contact face 65 of the second electrical conductor element 20 is shown in FIG. 2. As shown in FIG. 2, the predefined microstructure 75 has a plurality of recesses 80, 85 arranged in the second contact face 85. In an embodiment the recesses 80, 85 are each formed like a cup; in the plan view in FIG. 2, the recess 80, 85 has a circular exemplary configuration.

The recesses 80, 85 are arranged, by way of example, in a regular pattern in the second contact face 65 as shown in FIG. 2. The recesses 80, 85 are formed substantially identically to one another. Each of the recesses 80, 85 has a maximum transverse extent a, shown in FIG. 2, parallel to the second contact face 65. The transverse extent a has a first value that, in an embodiment, is in a range of 50 μm to 300 μm or of 100 μm to 200 μm. As shown in FIG. 2, the transverse extent a can be identical parallel to the x-axis and parallel to the y-axis. A first recess 80 of the predefined microstructure 75 may have a predefined minimum distance b from the closest recess 80, 85, for example, a second recess 85 parallel to the second contact face 65. The predefined minimum distance b has a second value in a range of 20 μm to 200 μm and, in another embodiment, in a range of 50 μm to 100 μm.

The predefined microstructure 75, as shown in the embodiment of FIG. 2, has a bulge 90 between the first recess 80 and the second recess 85. The bulge 90 can also be dispensed with, such that the predefined microstructure 75 is formed between the first recess 80 and the second recess 85 substantially running in a plane, and thus in a planar manner. By way of the bulge 90, a surface of the second contact face 65 is additionally enlarged.

Figure 3:
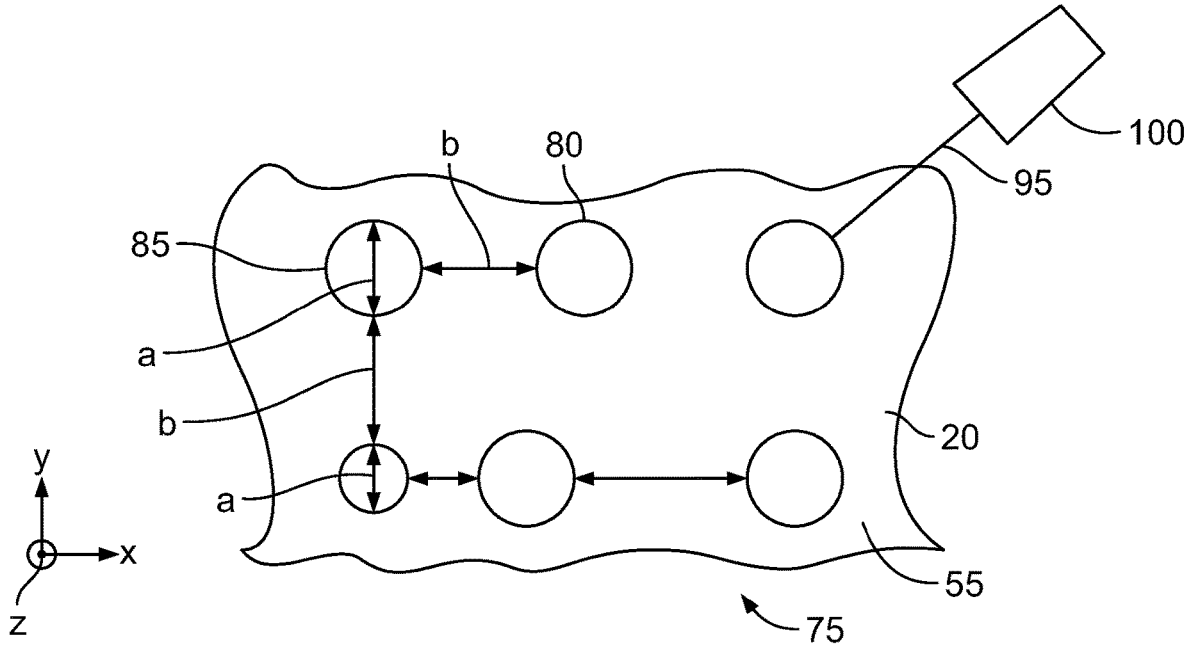
FIG. 3 is a plan view of a development of a contact face of an electrical conductor element according to another embodiment.

A second electrical conductor element 20 according to another embodiment shown in FIG. 3 is formed substantially identically to that configuration of the second electrical conductor element 20 which is shown in FIGS. 1 and 2. In contrast to this, in the second electrical conductor element 20 shown in FIG. 3, the predefined microstructure 75 has an irregular pattern in the arrangement of the recesses 80, 85. Thus, the recesses 80, 85 can have a different minimum distance b from one another. Furthermore, the recesses 80, 85 are arranged differently in relation to one another and have a different maximum transverse extent a. A combination thereof is also conceivable.

As shown in FIG. 3, the predefined microstructure 75 may be burned into the second contact section 60, for example by an electromagnetic radiation 95 from a radiation source 100. In an embodiment, the electromagnetic radiation 95 from the radiation source 100 is light, and may be a laser light. The laser light can be created, for example, by a fiber laser formed as the radiation source 100.

Figure 4:
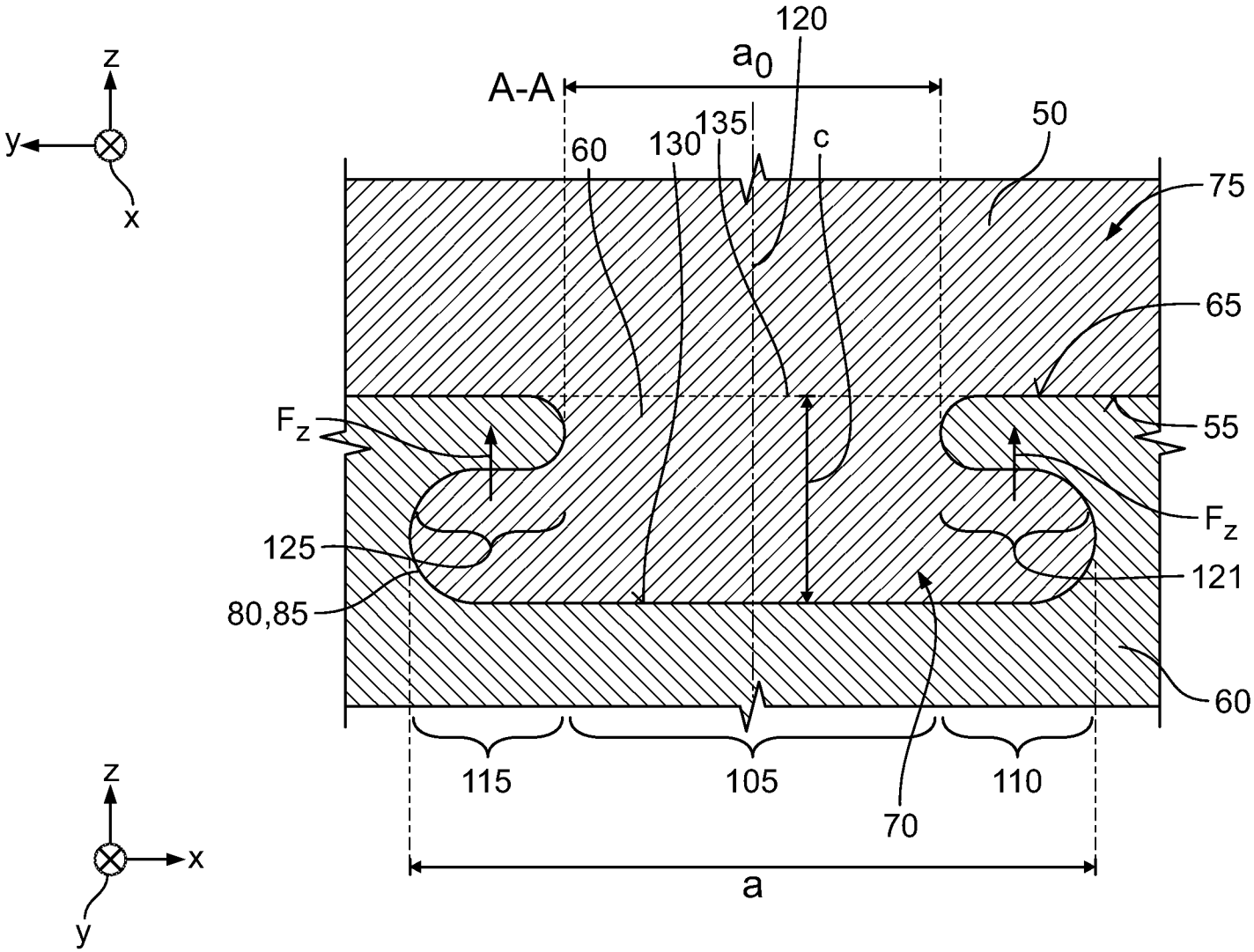
FIG. 4 is a sectional side view of the conducting arrangement, taken along section plane A-A of FIG. 1.

A section through the conducting arrangement 10 is shown in FIG. 4, taken along section plane A-A of FIG. 1. The recess 80, 85 has, as shown in FIG. 4, a first section 105, a second section 110 and, in the shown embodiment, a third section 115. Another number of sections 105, 110, 115 is also conceivable. The first section 105 is arranged adjacently in the transverse direction between the second section 110 and the third section 115. The sections 105, 110, 115 are adjacent to a recess base 130 in the vertical direction. Above the first section 105, the recess has an aperture 135 in the direction of the axis 120. In the shown embodiment, the recess base 130 runs, by way of example, substantially parallel to the second contact face 65. Of course, other alignments of the recess base 130 are also conceivable.

The recess 80, 85 is formed, in the embodiment of FIG. 4, rotationally symmetrically to the axis 120. The axis 120 is arranged parallel to a normal vector of the second contact face 65 and runs parallel to the z-axis. In other embodiments, the recess 80, 85 of the predefined microstructure 75 may be formed axially symmetrically to a plane in which the axis 120 is arranged or may be formed in another way, for example, asymmetrically. In the shown embodiment, the recess 80, 85 has a maximum depth c perpendicular to the second contact face 65. The depth c has a third value, which lies in a range of 50 μm to 300 μm, and in another embodiment, in a range of 100 μm to 200 μm. The maximum depth c runs perpendicular to the maximum transverse extent a in the z-direction. The recess 80, 85 can also be formed as a through-hole.

As shown in FIG. 4, the second section 110 is delimited in the vertical direction by a first collar section 121 of the second contact section 60, on a side facing away from the recess base 130. The first collar section 121 is adjacent to the second contact face 65 on the upper side. The first collar section 121 delimits the aperture 135 laterally. The aperture 135 has an aperture width a0. The aperture width a0 is smaller than the maximum transverse extent a of the recess 80, 85. In an embodiment, the aperture width a0 is 30 to 50% smaller than the maximum transverse extent a.

As shown in FIG. 4, the third section 115 is delimited by a second collar section 125 of the second contact section 60, on a side facing away from the recess base 130. The second collar section 125 is adjacent to the second contact face 65 on the upper side. The second collar section 125 delimits the aperture 135 opposite the first collar section 121. The collar sections 121, 125 constrict the recess 80, 85 with respect to the second contact face 65. The collar sections 121, 125 extend approximately over 20 to 50% of the maximum depth c in the z-direction.

The recess 80, 85 is substantially completely filled with the first material of the first contact section 50, as shown in FIG. 4. As a result, in the recess 80, 85 the contact section 50 engages behind the collar section 120, 125 in the second and third sections 110, 115. As a result, the first contact section 50 can transfer a particularly high pulling force FZ onto the second contact section 60.

Figure 5:
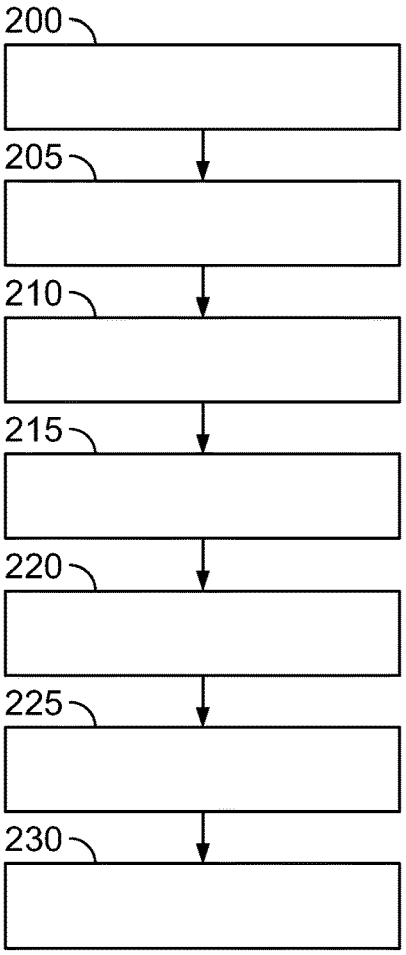
FIG. 5 is a flowchart of a method for producing the conducting arrangement.

A method for producing the conducting arrangement 10 is shown in FIG. 5.

In a first step 200, the first electrical conductor element 15 is provided, for example, by a first delivery into a manufacturing machine, and the second electrical conductor element 20 is provided, for example, by a second delivery to the manufacturing machine.

In a second step 205, in the configuration of the first electrical conductor element 15 as an electrical conducting component 25, the jacket 35 is separated from the electrical conductor 30 in the end region 40. In a different configuration of the first electrical conductor element 15, the second step 205 can be dispensed with.

In a third step 210, a coating is removed from the first contact section 50 of the first electrical conductor element 15; the first contact section 50 is purified by a laser coating-removal method. The first contact face 55 of the first contact section 50 can be contaminated in the removal of the coating.

In an embodiment, the second step 205 and the third step 210 are carried out as a combined step, with the jacket 35 being burned off from the electrical conductor 30 in the end region 40 by the laser coating-removal. Furthermore, after the jacket 35 has been burned off, the end region 40 is purified by the laser coating-removal.

In another embodiment, the second step 205 and the third step 210 are executed separately one after the other. In the second step 205, the jacket 35 is mechanically removed from the end region 40, for example stripped off. In the third step 210, the first contact face 55 is then purified, for example by the laser coating-removal.

In a fourth step 215, the predefined microstructure 75 is introduced into the second contact face 65. The predefined microstructure 75 may be burned into the second contact face 65 by the radiation source 100. The radiation source 100 can be operated in a pulsed and/or modulated manner. The electromagnetic radiation can also be deflected by a mirror and/or can be focused by at least one lens on the second contact face 65.

In a fifth step 220, the first contact section 50 and the second contact section 60 are positioned in an end position, and the first contact face 55 and the second contact face 65 are pressed onto one another.

In a sixth step 225, the first contact section 50 is welded to the second contact section 60 by a welding method. In an embodiment, the welding method is an ultrasound welding method, in particular an ultrasound friction welding method. As a result of the upwardly open configuration of the first section 105, the first material of the first electrical conductor element 15 penetrates particularly well into the recess 80, 85 during the welding method, and would then be pressed in the transverse direction into the second and third sections 110, 115 by way of the first section 105, such that the recess 80, 85 of the predefined microstructure 75 is substantially completely filled with the first material. The penetration of the liquefied first material into the recess 80, 85 of the predefined microstructure 75 is enhanced by the pressing of the first contact section 50 onto the second contact section 60. It is also thereby ensured that the recess 80, 85 of the predefined microstructure 75 is substantially completely filled.

In a seventh step 230, the conducting arrangement 10 is cooled down.

As a result of the above-described configuration of the conducting arrangement 10 and also the described production method for producing the conducting arrangement 10, it is ensured that deep penetration of the first material of the first electrical conductor element 15 into the predefined microstructure 75 takes place as a result of the simultaneous pressing-on of the first and second contact sections 50, 60 with simultaneous welding. Furthermore, the provision of the predefined microstructure 75 guarantees that, despite the contamination of the first contact section 50 that may possibly occur in the third step 210, a particularly good and reliable welded connection 70 can be produced between the first electrical conductor element 15 and the second electrical conductor element 20, so that process safety in the production of the conducting arrangement 10 is particularly good.

Figure 6:
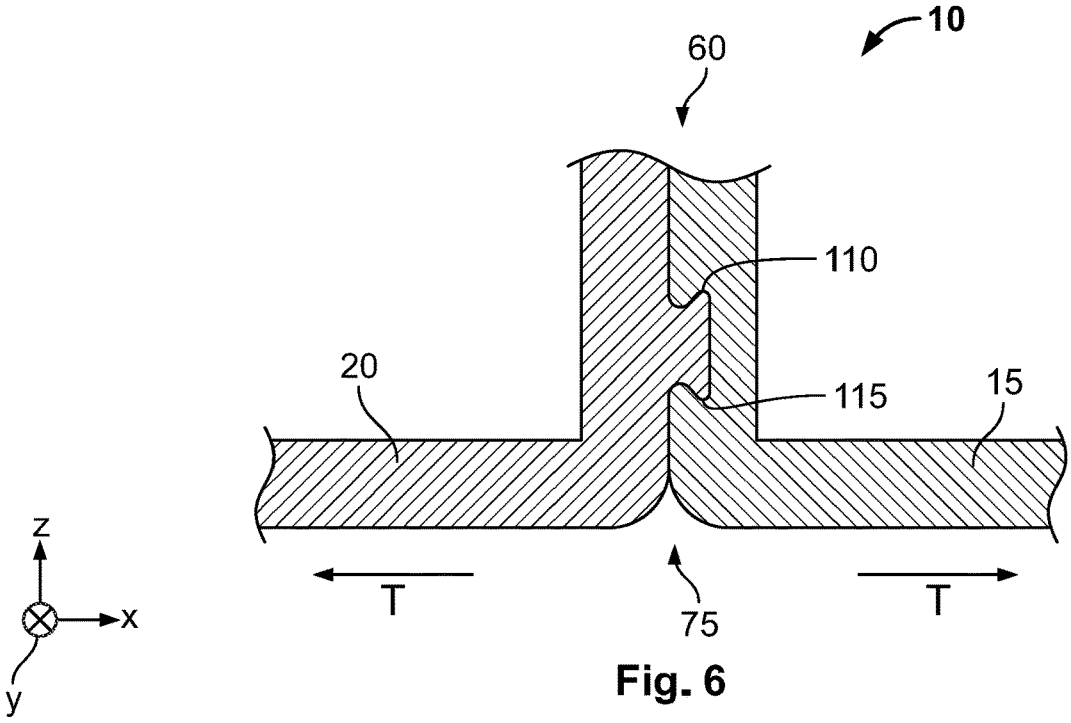
FIG. 6 is a sectional side view of the conducting arrangement during a peel test.

The conducting arrangement 10 is shown during a peel test in FIG. 6. During the peel test, the first electrical conductor element 15 is pulled off the second electrical conductor element 20, in such a way that the two electrical conductor elements 15, 20 are pulled in opposite directions. In this case, the first and second electrical conductor elements 15, 20 each deform, such that the welded connection 70 is subjected substantially to a linear load T. As a result of the predefined microstructure 75, a particularly high separation force is necessary in the peel test, in order to separate the first electrical conductor element 15 from the second electrical conductor element 20. Furthermore, particularly high forces can be transferred between the first electrical conductor element 15 and the second electrical conductor element 20 as a result of the first material of the first electrical conductor element 15 engaging behind in the second and third sections 110, 115.

In other embodiments, the predefined microstructure 75 can, of course, also be formed in a way other than as described in FIGS. 1-6. The steps 200 to 230 can also be carried out in a different sequence than described above.

What is claimed is:

1. A conducting arrangement, comprising:

a first electrical conductor element having a first contact section with a first material; and a second electrical conductor element having a second contact section welded to the first contact section, a side of the second contact section facing the first contact section has a predefined microstructure including a recess bounded continuously about its perimeter, the first material of the first contact section at least partially fills the recess of the predefined microstructure.

2. The conducting arrangement of claim 1, wherein the predefined microstructure has a plurality of recesses each substantially completely filled with the first material.

3. The conducting arrangement of claim 2, wherein the recesses are each formed substantially identically to one another.

4. The conducting arrangement of claim 2, wherein the recesses are arranged at a predefined distance from a contact face of the second contact section facing the first contact section.

5. The conducting arrangement of claim 2, wherein each recess has a minimum distance from an adjacent recess of 20 μm to 200 μm.

6. The conducting arrangement of claim 1, wherein the recess has a maximum transverse extent of 50 μm to 300 μm.

7. The conducting arrangement of claim 6, wherein the recess has a maximum depth of 50 μm to 300 μm.

8. The conducting arrangement of claim 1, wherein the recess is a through-hole.

9. The conducting arrangement of claim 1, wherein the recess extends into the second contact section in a first vertical direction perpendicular to the side of the second contact section facing the first contact section and has a first section open toward the first contact section in a second vertical direction opposite the first vertical direction, the first material of the first contact section insertable into the recess in the first vertical direction.

10. The conducting arrangement of claim 9, wherein the recess has a second section arranged adjacent to the first section in a transverse direction, a collar section of the second contact section is disposed between the second section and the first contact section in the second vertical direction.

11. The conducting arrangement of claim 10, wherein the collar section comprises an annular protrusion extending radially inward with respect to a central axis of the recess.

12. The conducting arrangement of claim 1, wherein the second contact section has a second material different from the first material.

13. The conducting arrangement of claim 12, wherein the first material has a lower pulling strength than the second material.

14. The conducting arrangement of claim 13, wherein the first material is a copper material and the second material is an aluminum material.

15. The conducting arrangement of claim 14, wherein the copper material is an E-Cu copper or a Cu-ETP copper and the aluminum material is an EN AW-1050A aluminum alloy or an Al 1100 aluminum alloy.

16. The conducting arrangement of claim 1, wherein the first electrical conductor element has an electrical conducting component, the first contact section is arranged on an electrical conductor of the electrical conducting component.

17. The conducting arrangement of claim 16, wherein the second electrical conductor element has a contact, the second contact section is arranged on the contact.

18. The conducting arrangement of claim 1, wherein the side of the second contact section facing the first contact section comprises a generally planar surface, the recess defining an opening in the generally planar surface having a width in a direction parallel to the planar surface that is smaller than a width of another portion of the recess.

19. The conducting arrangement of claim 1, wherein the side of the second contact element facing the first contact section comprises a generally planar surface, a first portion of the first material of the first contact section arranged on the generally planar surface of the second contact element and a second portion of the first material arranged within the recess of the predefined microstructure.

20. A method for producing a conducting arrangement, comprising:

providing a first electrical conductor element and a second electrical conductor element;

removing a section of a coating from a first contact section of the first electrical conductor element;

creating a predefined microstructure on a second contact section of the second electrical conductor element, the predefined microstructure including a recess bounded continuously about its perimeter; and welding the first contact section to the second contact section.

21. The method of claim 20, wherein the predefined microstructure is burned into the second contact section.

22. The method of claim 21, wherein the predefined microstructure is burned in by electromagnetic radiation.

23. The method of claim 20, wherein the first contact section and the second contact section are welded by ultrasound welding.

* * * * *